US008893730B2

(12) United States Patent
Pun

(10) Patent No.: US 8,893,730 B2
(45) Date of Patent: Nov. 25, 2014

(54) CASE

(71) Applicant: Simnex Industrial Limited, Tsim Sha Tsui East, Kowloon (HK)

(72) Inventor: Lee Man Pun, Kowloon (HK)

(73) Assignee: Simnex Industrial Limited, Hong Kong (HK)

( * ) Notice: Subject to any disclaimer, the term of this patent is extended or adjusted under 35 U.S.C. 154(b) by 0 days.

(21) Appl. No.: 13/860,549

(22) Filed: Apr. 11, 2013

(65) Prior Publication Data

US 2014/0306587 A1 Oct. 16, 2014

(51) Int. Cl.

| | |
|---|---|
| ***A45D 33/32*** | (2006.01) |
| ***A45D 42/10*** | (2006.01) |
| ***A45D 27/22*** | (2006.01) |
| ***B65D 43/14*** | (2006.01) |
| ***A45D 42/00*** | (2006.01) |
| ***B65D 69/00*** | (2006.01) |
| ***B65D 71/00*** | (2006.01) |
| ***F21V 33/00*** | (2006.01) |
| ***A47B 67/00*** | (2006.01) |
| ***A47B 81/06*** | (2006.01) |
| ***A45C 15/04*** | (2006.01) |

(52) U.S. Cl.

CPC ..... *A47B 67/005* (2013.01); *A47B 81/06* (2013.01); *A45C 15/04* (2013.01); *A45D 33/32* (2013.01); *Y10S 206/823* (2013.01)

USPC ..... 132/288; 132/315; 132/316; 206/581; 206/823; 206/235; 362/136

(58) Field of Classification Search

CPC ..... A45D 33/32; A45D 40/22; A45C 15/04; A45C 15/06; A45C 11/008; A47B 67/005; A47B 81/06

USPC ..... 132/288, 286, 291, 301, 304, 315, 316, 132/294; 206/581, 823, 573, 576, 579, 235, 206/6.1, 486, 487; 248/466, 469, 472, 473, 248/474, 475.1, 476, 477, 479, 495; 312/224, 226, 902; D3/205, 212, 215, D3/900, 901; 362/135, 136, 142, 144

See application file for complete search history.

(56) References Cited

U.S. PATENT DOCUMENTS

| | | | | | |
|---|---|---|---|---|---|
| 738,626 | A | * | 9/1903 | Newell | 132/315 |
| 1,443,858 | A | * | 1/1923 | Windecker | 312/227 |
| 1,499,361 | A | * | 7/1924 | Freund | 132/315 |
| 1,519,873 | A | * | 12/1924 | Mosonillo | 132/294 |
| 1,638,356 | A | * | 8/1927 | McKash | 132/315 |
| 1,638,638 | A | * | 8/1927 | Lewis | 132/315 |
| 1,651,898 | A | * | 12/1927 | Maillard | 132/288 |
| 1,652,771 | A | * | 12/1927 | Deubel | 132/315 |
| 1,667,564 | A | * | 4/1928 | Pearson | 312/201 |
| 1,730,555 | A | * | 10/1929 | Brennan | 132/316 |
| 1,752,948 | A | * | 4/1930 | Herrmann | 190/108 |
| 1,973,283 | A | * | 9/1934 | Buttrick | 190/111 |
| 1,999,476 | A | * | 4/1935 | Pollock | 312/226 |
| 2,046,393 | A | * | 7/1936 | Lewinsohn et al. | 362/144 |
| 2,145,462 | A | * | 1/1939 | Speck | 132/288 |

(Continued)

*Primary Examiner* — Vanitha Elgart

(57) ABSTRACT

A case includes a base, a cover and a mirror. The base defines a space for accommodating objects and an opening communicating the space with the outside. The cover is hinged onto the base for sealing the opening of the base. The mirror is detachably mounted in the cover with a back side thereof facing the cover.

13 Claims, 16 Drawing Sheets

(56) References Cited

U.S. PATENT DOCUMENTS

| | | | | | |
|---|---|---|---|---|---|
| 2,224,995 | A | * | 12/1940 | Vogel | 132/304 |
| 2,270,636 | A | * | 1/1942 | Klarfield | 362/136 |
| 2,461,421 | A | * | 2/1949 | Jacobus | 132/316 |
| 2,487,883 | A | * | 11/1949 | Le Baron | 132/288 |
| 2,570,314 | A | * | 10/1951 | Brand | 132/304 |
| 2,635,612 | A | * | 4/1953 | Dean | 132/288 |
| 3,001,748 | A | * | 9/1961 | Austin | 248/468 |
| 3,179,891 | A | * | 4/1965 | Sharma | 455/231 |
| 3,381,119 | A | * | 4/1968 | Brickman et al. | 362/137 |
| 3,381,120 | A | * | 4/1968 | Stern et al. | 362/136 |
| D215,634 | S | * | 10/1969 | Andre | D3/275 |
| 3,537,552 | A | * | 11/1970 | Noble | 190/111 |
| 3,858,592 | A | * | 1/1975 | Rickenbaker | 132/288 |
| 4,119,107 | A | * | 10/1978 | Pinzone et al. | 132/316 |
| 4,192,329 | A | * | 3/1980 | Swearingen | 132/287 |
| 4,262,685 | A | * | 4/1981 | Workman et al. | 132/315 |
| 4,269,206 | A | * | 5/1981 | Boyd | 132/288 |
| 4,361,981 | A | * | 12/1982 | Reiling et al. | 446/219 |
| 4,688,861 | A | * | 8/1987 | Culver | 312/223.5 |
| 4,821,751 | A | * | 4/1989 | Chen | 132/295 |
| 4,936,463 | A | * | 6/1990 | Tiramani | 206/581 |
| 5,054,505 | A | * | 10/1991 | Yuhara | 132/294 |
| 5,218,978 | A | * | 6/1993 | Yang et al. | 132/304 |
| 5,392,162 | A | * | 2/1995 | Glucksman | 359/872 |
| 5,832,941 | A | * | 11/1998 | Murillo | 132/316 |
| 7,614,756 | B2 | * | 11/2009 | Yue | 359/872 |
| 7,740,370 | B2 | * | 6/2010 | Campbell et al. | 362/135 |
| 8,522,795 | B2 | * | 9/2013 | Bouix et al. | 132/301 |
| 2012/0242204 | A1 | * | 9/2012 | Boyer | 312/226 |

* cited by examiner

CASE

TECHNICAL FIELD

The present invention relates to a kind of case.

BACKGROUND

Cases, such as cosmetics cases, are generally used to accommodating cosmetics, toiletries, and etc., for being easily carried by users. Such cases in the art are usually equipped with mirrors, thus the users can apply cosmetics conveniently, particularly in outdoors. However, such cases usually have the mirrors be integrally fixed in bases, thus function of the cases is simple, which cannot meet increasingly diverse needs of the users.

SUMMARY

The technical question to be resolved by the present invention is to provide an improved case to overcome shortcomings in related art.

The technical solution of the present invention overcoming the technical question is as follows:

A case includes a base, a cover and a mirror. The base defines a space for accommodating objects and an opening communicating the space with the outside. The cover is hinged onto the base for sealing the opening of the base. The mirror is detachably mounted in the cover with a back side thereof facing the cover.

Preferably, the mirror includes a frame and a mirror body, the frame being detachably mounted on the cover, the mirror body being mounted in the frame, the support device including a bracket and a hinged unit, the frame including a lower hinged seat, the hinged unit being mounted on the lower hinged seat, the bracket being rotatably connected to the hinged unit, wherein when the bracket rotates to a first position, the bracket is received in the frame of the mirror, and when the bracket rotates to a second position, the bracket and the frame form an angle there between for stablely placing the mirror.

Preferably, the hinged unit includes a sleeve, a position seat, an upper hinged seat, and a rotating shaft, the sleeve including a first end and a second end, the first end being fixedly connected to the bracket, the second end being arranged between the upper hinged seat and the position seat, the rotating shaft being inserted in the sleeve, thereby the bracket being rotatable, a plurality of slots being evenly defined on an outer surface of the second end along a rotation direction thereof, the position seat being tangential to the outer surface of the second end, the position seat defining fifth connecting holes in two ends thereof for fixedly connecting the lower hinged seat, wherein the position seat forms an elastic protrusion corresponding to the slots, the elastic protrusion engages in one of the slots to lock the bracket, and the elastic protrusion engages in different slots to adjust the angle between the bracket and the frame.

Preferably, the mirror includes a lighting device and for a player, the lighting device being used for providing sufficient intensity illumination in dark, the player being used for playing audio.

Preferably, the cover includes a locking protrusion, the mirror includes a latching device acting with the locking protrusion to form detachability of the mirror and cover, wherein when the latching device is in a first state, the latching device engages with the locking protrusion; and when the latching device is in a second state, the latching device disengages from the locking protrusion.

Preferably, the latching device includes a resetting member, the resetting member driving the latching device back to the first state when external force acting on the latching device is canceled.

Preferably, the latching device further includes a latching member and a second fixing member, the latching member is mounted on the mirror, the latching member including an operation part and a latching part, the operation part and the latching part being respectively formed at opposite ends of the latching member, the operation part being exposed out of the mirror, the latching part being a hook extending towards the back side of the mirror for acting with the locking protrusion, the second fixing member defining fourth connecting holes for connecting the latching part and the mirror.

Preferably, the resetting member includes a fixing protrusion formed on the second fixing member, a guiding protrusion formed on the latching member, and a first elastic member interconnecting the fixing protrusion and the guiding protrusion, the second fixing member defining a guiding groove for limiting movement of the guiding protrusion, wherein when the external force acting on the latching device is canceled, the guiding protrusion drives the latching member move along the guiding groove until the latching device at the first state.

Preferably, the cover includes a sidewall, the sidewall including a position protrusion formed thereon, the mirror defining a position hole corresponding to the position protrusion, thereby ensuring stability of the mirror when the mirror is mounted in the cover.

Preferably, the mirror includes a frame and a mirror body, the frame being detachably connected to the cover, the mirror body being fixed on the frame, the frame defining a power installation seat for mounting portable power source which supplies electric power to the lighting device and/or the player.

Preferably, a control unit is arranged on the frame of the mirror for controlling connection between the power source and the lighting device and/or the player.

Preferably, the frame includes a front frame and a rear frame, the front frame and the rear frame fixing the mirror body there between, a first mounting hole being defined in the front frame, the mirror body being mounted in the first mounting hole and orientated towards the base, the rear frame being coupled to an inner side of the cover.

Preferably, the mirror includes a frame and a mirror body, the frame being detachably connected to the cover, the mirror body being fixed on the frame, at least one resilient device being formed on the frame, wherein when the latching device engages with the locking protrusion, the resilient device is received in the frame, and when the latching device disengages from the locking protrusion, the resilient device separates the mirror from the inner side of the cover.

Preferably, the case is cosmetics case.

Preferably, the cover includes a top wall, and sidewalls formed around the top wall, the top wall and the sidewalls cooperatively defining a first space, the mirror being detachably mounted in the first space and having a size matching the first space.

BRIEF DESCRIPTION OF THE DRAWINGS

The present invention will be described in detail with reference to the drawings and embodiments. In the drawings.

DETAILED DESCRIPTION OF EMBODIMENTS

For better understanding of the technical features, the purpose and effect of the present invention, embodiments of the present invention will be described in detail with reference to the drawings.

Figure 1:
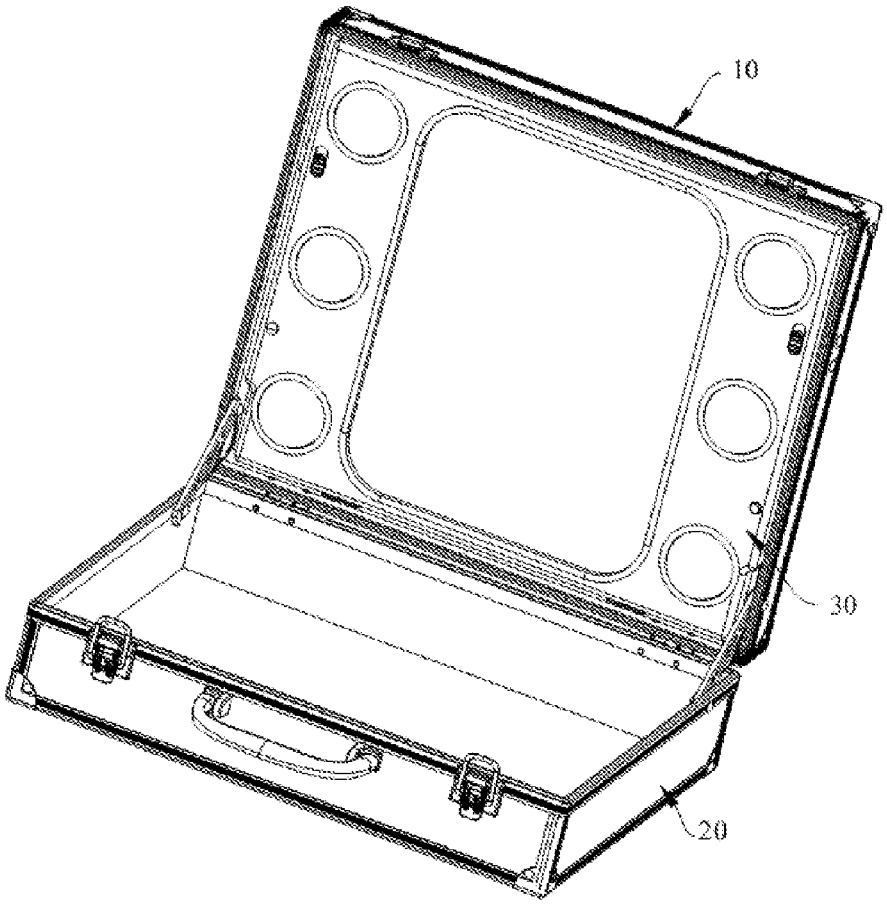
FIG. 1 is a schematic view of a case according to a first embodiment of the present invention in an open state.

FIG. 1 illustrates a case of a first embodiment of the present invention, which may be a cosmetics case. The case includes a cover 10, a base 20 and a mirror 30. The cover 10 and the base 20 each define an opening. The openings of the cover 10 and the base 20 face each other. One side edge of the cover 10 is hinged to a side edge of the base 20 to seal the opening of the base 20. The case defines a first space, for receiving cosmetics, toiletries, and etc. The mirror 30 is detachably mounted on the cover 10, with a back side thereof facing the cover 10, so that the mirror 30 is available for users to apply cosmetics when the cover 10 is open.

Figure 2:
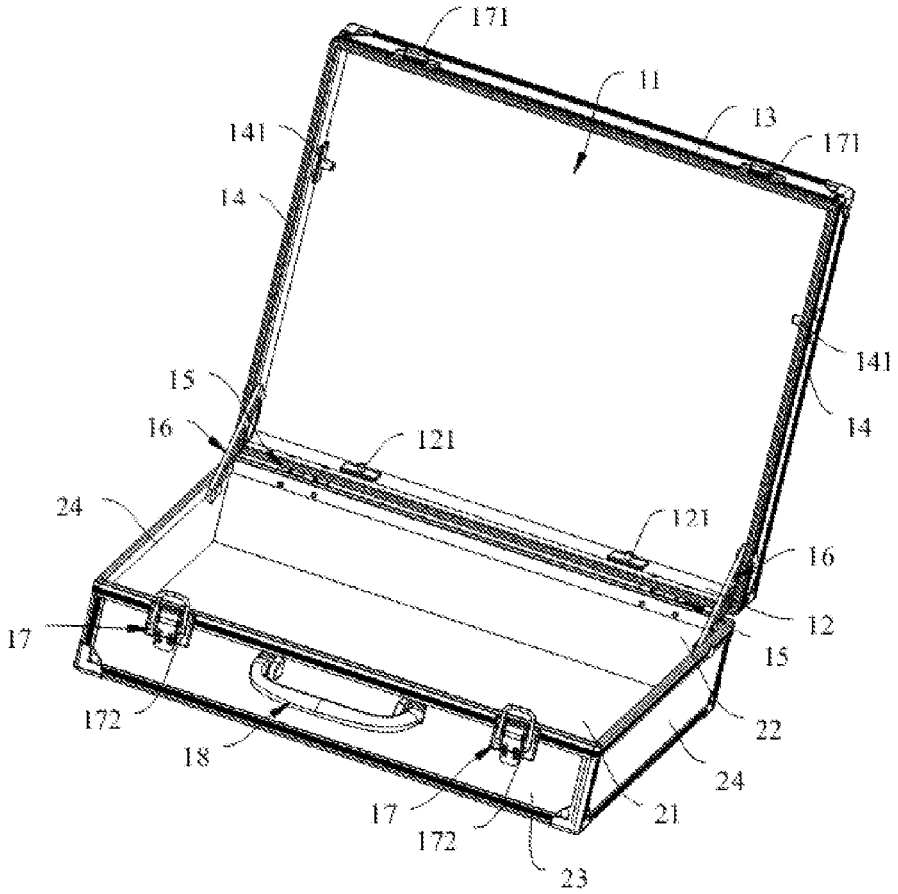
FIG. 2 is a schematic view of a base of the case of the first embodiment of the present invention.

As shown in FIG. 2, in some embodiments, the cover 10 includes a top wall 11, a first sidewall 12, a second sidewall 13, and a pair of third sidewalls 14 opposite to each other. The top wall 11 may be square. The first sidewall 12 and the second sidewall 13 are formed at two opposite sides of the top wall 11. The two third sidewalls 14 are formed at other two opposite sides of the top wall 11. The top wall 11, the first sidewall 12, the second sidewall 13, and the third sidewalls 14 cooperatively define a second space. The mirror 30 is detachably mounted in the second space, with a size matching the second space.

The base 20 includes a bottom wall 21, a fourth sidewall 22, a fifth sidewall 23, and a pair of sixth sidewalls 24 opposite to each other. The bottom wall 21 may be square. The fourth sidewall 22 and the fifth sidewall 23 are formed at two opposite sides of the bottom wall 21, and the two sixth sidewalls 24 are formed at other two opposite sides of the bottom wall 21, thereby cooperatively defining the first space. Hinges 15 are formed between the first sidewall 12 of the cover 10 and the fourth sidewall 22 of the base 20, jointing the cover 10 and the base 20 together with the cover 10 being rotatable relative to the base 20 to open or closed. It should be understood that the shapes of the top wall 11 and the bottom wall 21 may be other shapes in other embodiments.

Referring to FIG. 2 again, in some embodiments, two position protrusions 121 are formed at an inner side of the first sidewall 12 of the cover 10. The position protrusions 121 extend vertically from the first sidewall 12 towards a middle of the top wall 11. The two opposite third sidewalls 14 each form a locking protrusion 141 at an inner side thereof. The two locking protrusions 141 extend vertically from the third sidewalls 14 towards the middle of the top wall 11. The position protrusions 121 and the locking protrusions 141 may be column-shaped poles, being respectively connected to the first sidewall 12 and the third sidewalls 14 by screwing or riveting. The position protrusions 121 and the locking protrusions 141 are designed to act with the mirror 30, forming detachable connection and position of the mirror 30.

In some embodiments, two position devices 16 may be respectively formed between the two third sidewalls 14 of the cover 10 and the two sixth sidewalls 24 of the base 20 to support the cover 10, keeping the cover 10 in open state and forming different angles between the cover 10 and the base 20. A lockset 17 includes a locking head 171 and a locking body 172 formed on outer sides of the second sidewall 13 of the cover 10 and the fifth sidewall 23 of the base 20, respectively. The locking head 171 and the locking body 172 lock with each other when the cover 10 and the base 20 are closed. A handle 18 is formed on the outer side of the fifth sidewall 23 of the base 20, thus the case can be easily carried when not in use.

Figure 3:
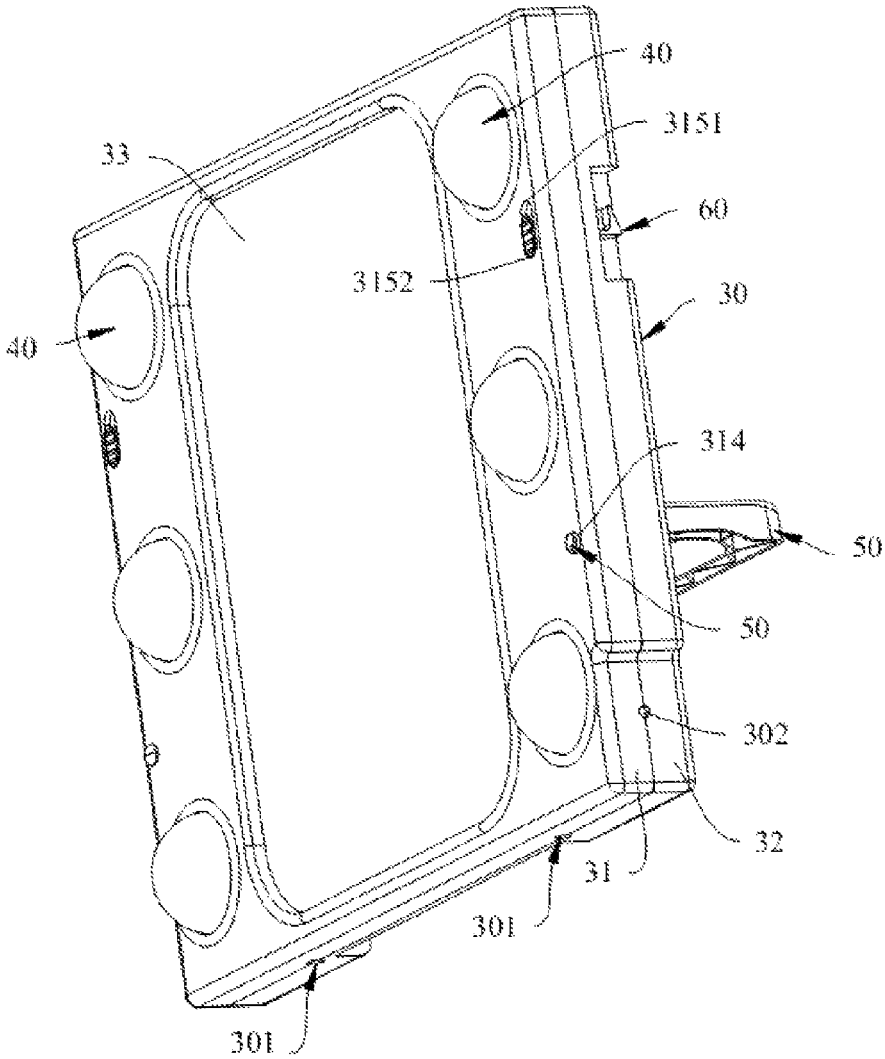
FIG. 3 is a schematic view of a mirror of the case of the first embodiment of the present invention.
Figure 4:
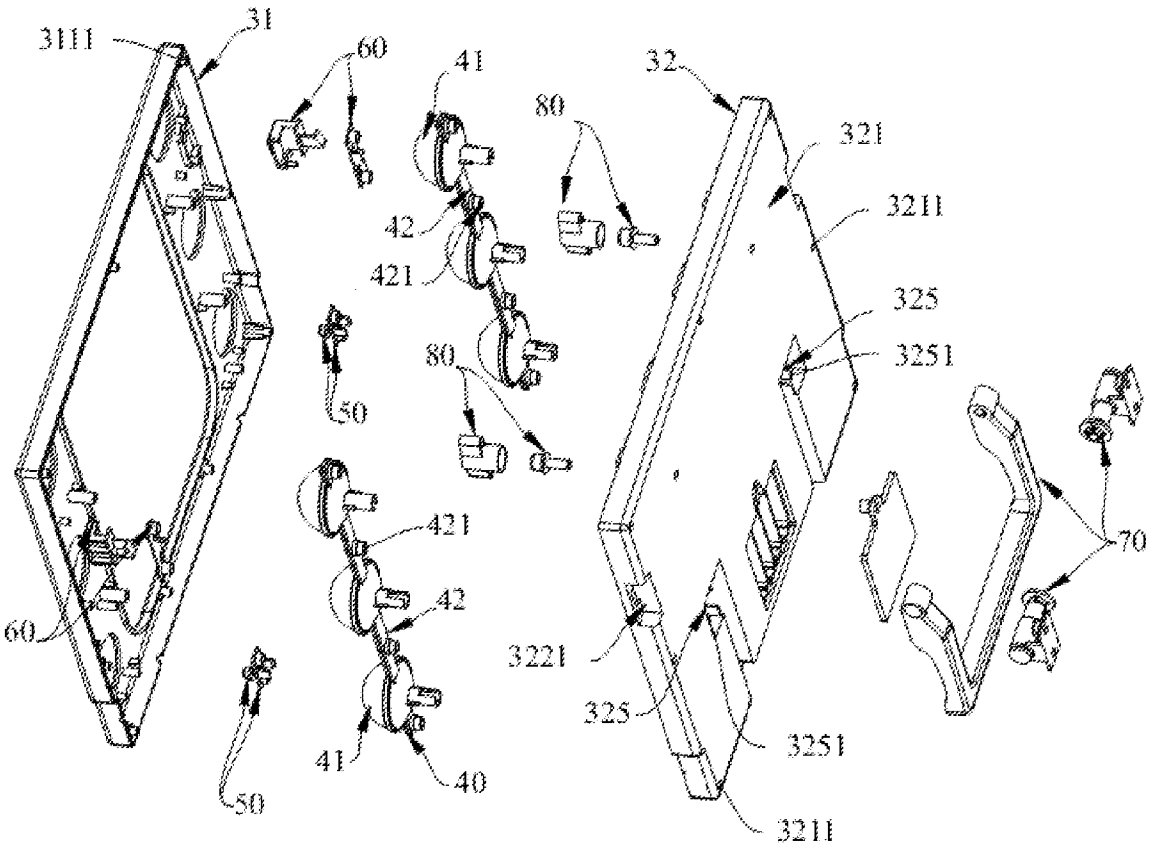
FIG. 4 is an exploded view of the mirror of the case of the first embodiment of the present invention.

As shown in FIGS. 3 and 4, in some embodiments, the mirror 30 has the size matching that of an internal space (i.e., the second space) of the cover 10, and is inserted in the internal space of the cover 10. The mirror 30 may includes a front frame 31 and a rear frame 32 with open sides thereof opposite to and matching with each other, and a mirror body 33 sandwiched between the front frame 31 and the rear frame 32. The mirror body 33 may be square, for dressing up of users. In other embodiments, the mirror 30 may be other regular shapes, such as circular, or be irregular. Position holes 302 are defined in contacting surfaces of the front frame 31 and the rear frame 32. In this embodiment, the position holes 302 are two in number, corresponding to and acting with the position protrusions 121 of the cover 10.

In some embodiments, the mirror 30 may further include a lighting device 40, control units 50 and latching devices 60. The lighting device 40, the control units 50 and the latching devices 60 may all be formed on the front frame 31. The lighting device 40 is used for illumination in dark. The control units 50 are used for controlling power switches of the lighting device 40. The latching devices 60 act with the locking protrusion 141, forming detachable connection with the cover 10.

Figure 5:
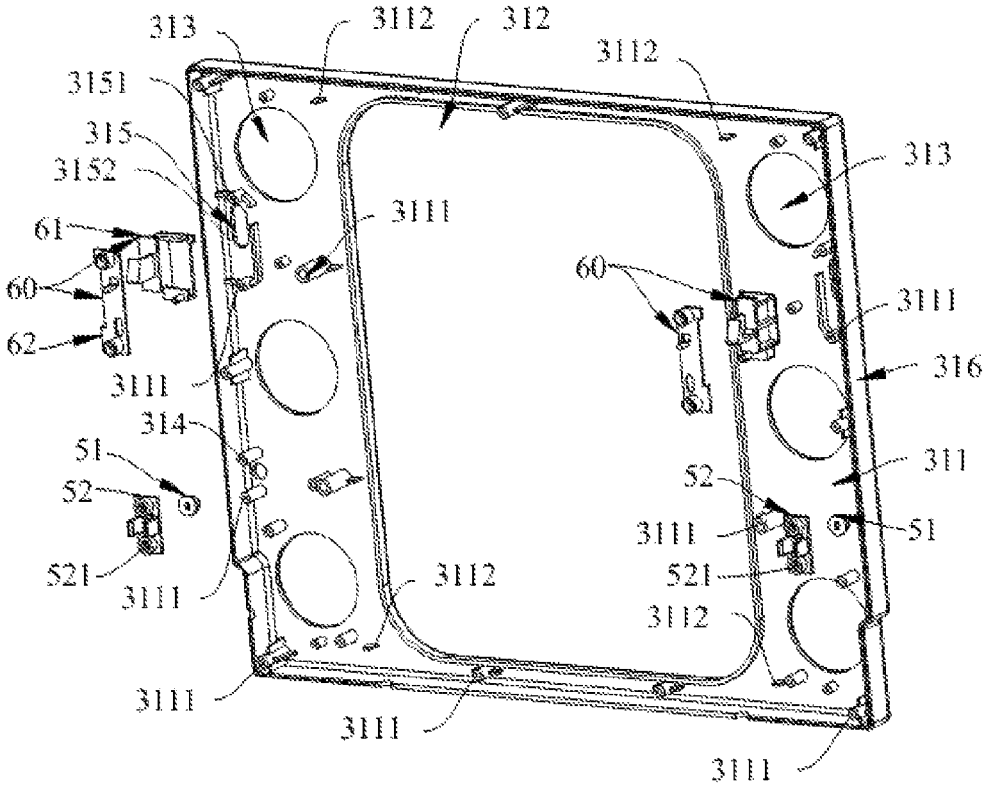
FIG. 5 is an exploded view of a front frame of the case of the first embodiment of the present invention.
Figure 6:
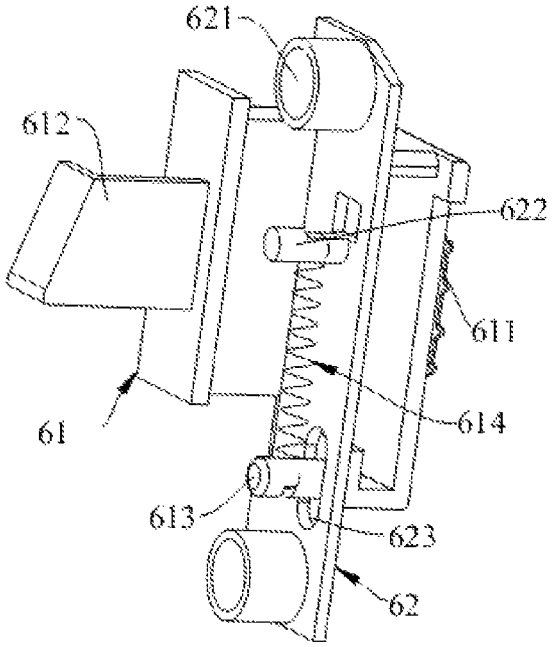
FIG. 6 is a schematic view of a latching device of the case of the first embodiment of the present invention.
Figure 7:
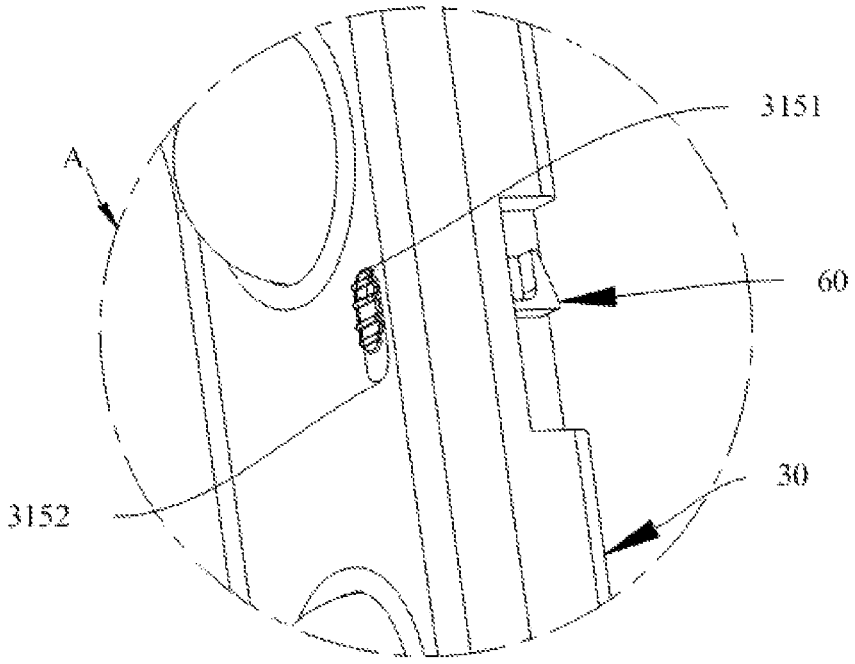
FIG. 7 is an enlarged view of the latching device in a first state.
Figure 8:
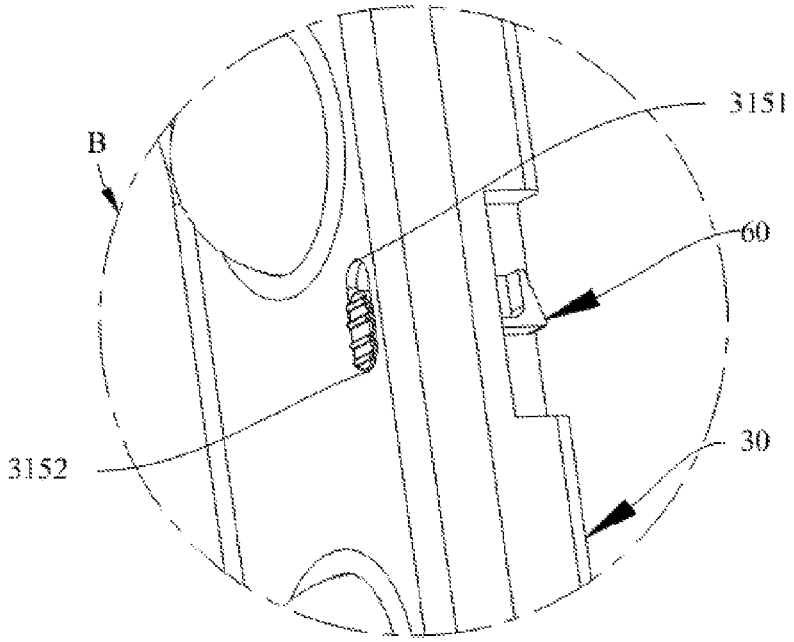
FIG. 8 is an enlarged view of the latching device in a second state.
Figure 9:
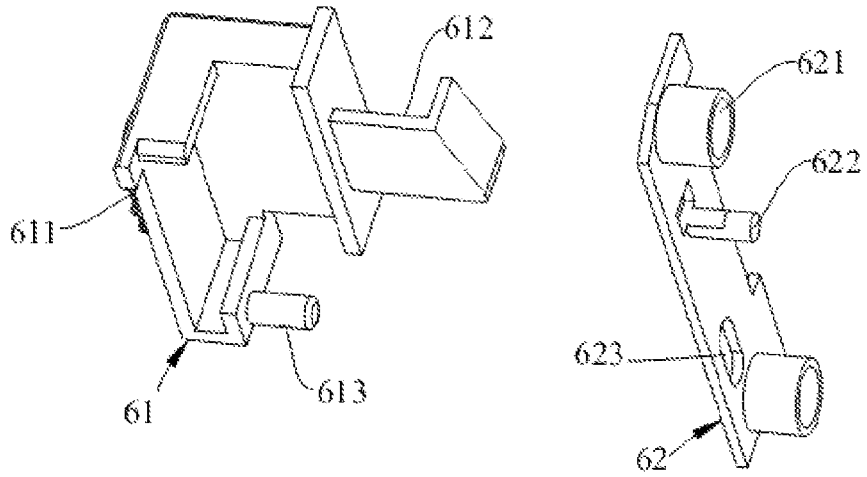
FIG. 9 is an exploded view of the latching device of the case of the first embodiment of the present invention.

As shown in FIG. 5, in some embodiments, the front frame 31 includes a first substrate 311 and a seventh sidewall 316 formed at a periphery of the first substrate 311. The first substrate 311 defines a plurality of first latching holes 3111 with different heights at an inner side thereof, for connecting other devices. The first substrate 311 further defines a first mounting hole 312, second mounting holes 313, third mounting holes 314, and fourth mounting holes 315 therein. The first mounting hole 312 is formed at a central portion of the first substrate 311 with a profile the same as that of the mirror body 33 and a size slightly less than that of the mirror body 33.

The mirror body 33 is mounted in the first mounting hole 312 from an inner side of the front frame 31. A plurality of limiting ribs 3112 are formed on the inner side of the first substrate 311, evenly arranged around the mirror body 33, for positioning the mirror 30 in a plane defined by the mirror body 33.

The second mounting holes 313 includes six circular through holes, evenly formed on two lateral sides of the mirror body 33 three in a line and parallel to corresponding third sidewall 14, for mounting the lighting device 40. The lighting device 40 includes six emitting bodies, two groups of lampshades 41, and two fixing frames 42 for fixing the emitting bodies, ensuring using of the case in dark. The emitting body can be ordinary incandescent bulbs, LEDs, and etc., for providing sufficient intensity illumination. Each three emitting bodies of the six emitting bodies are a group and connected in serious. The two groups of emitting bodies are respectively mounted on the two fixing frames 42, and connect to the power source. Each group of lampshades 41 includes three lampshades 41 corresponding to each group of emitting bodies. Each group of lampshades 41 is connected to a corresponding fixing frame 42, covering the corresponding emitting bodies. The lighting device 40 is mounted onto corresponding second mounting holes 313 from the inner side of the first substrate 311 after being assembled. Several of the first latching holes 3111 are formed adjacent to the second mounting holes 313. The fixing frames 42 define second connecting holes 421 corresponding to the several first latching holes 3111, thereby fixing devices, such as screws, connecting the fixing frames 42 onto the front frame 31. It should be understood that numbers, positions of the emitting bodies can be changed according to practical applications.

The third mounting holes 314 are two in number, and are defined in two opposite sides of the first substrate 311 which define the second mounting holes 313, for mounting the control units 50. Each control unit 50 includes a switch button 51, power switch, a first fixing member 52, and power wires. The switch button 51 is mounted to the third mounting hole 314 from the inner side of the first substrate 311, and exposed to an outer side of the first substrate 311. Several of the first latching holes 3111 are formed adjacent to the third mounting holes 314 corresponding to the first fixing members 52. The first fixing members 52 define third connecting holes 521 corresponding to the several first latching holes 3111 adjacent to the third mounting holes 314. The power switch is arranged between the switch button 51 and the first fixing member 52, and is fixed by fixing devices, such as screws. The power switch is connected to the power wires, thereby controlling supply of electric power of the power source to the lighting device 40.

The fourth mounting holes 315 include two waist-shaped through holes defined in the first substrate 311 corresponding to the locking protrusions 141, for mounting the latching devices 60. The latching devices 60 are mounted in the fourth mounting holes 315 and act with the locking protrusions 141, thereby forming detachable connection of the mirror 30. Each latching device 60 includes a latching member 61 and a second fixing member 62. The latching member 61 is mounted in the fourth mounting hole 315 from the inner side of the front frame 31. The latching member 61 can be made of plastic or metal with sufficient strength and lifespan. Several of the first latching holes 3111 are formed adjacent to the fourth mounting holes 315, corresponding to the second fixing members 62. The second fixing members 62 define fourth connecting holes 621 corresponding to the several first latching holes 3111 adjacent to the fourth mounting holes 315, fixing the latching members 61 in the fourth mounting holes 315 by fixing devices, such as screws, and ensuring that the latching members 61 are moveable along the waist-shaped fourth mounting holes 315. The latching member 61 includes an operation part 611 and a latching part 612. The operation part 611 and the latching part 612 are formed at opposite ends of the latching member 61. The operation part 611 is a protrusion extending through the fourth mounting hole 315 and exposed to the outer side of the first substrate 311. The latching part 612 is a right angled hook extending towards the rear frame 32, acting with the locking protrusion 141 of the cover 10. The latching member 61 moves between a first side 3151 and a second side 3152 of the fourth mounting hole 315 by operating the operation part 611, and thus makes the latching part 612 move to engage with or disengage from the locking protrusion 141.

Referring to FIG. 6 to FIG. 9, in some embodiments, the latching device 60 further includes a resetting member, for driving back the latching member 61 to the first side 3151 of the fourth mounting hole 315. The resetting member includes a fixing protrusion 622 formed on the second fixing member 62, a guiding protrusion 613 formed on the latching member 61, and a first elastic member 614 interconnecting the fixing protrusion 622 and the guiding protrusion 613. The second fixing member 62 defines a guiding groove 623 for limiting movement of the guiding protrusion 613. When there is not any external force on the operation part 611, the latching device 60 is in a first state A: the first elastic member 614 keeps the latching part 612 at the first side 3151, and makes the latching member 61 engage with the locking protrusion 141. When the operation part 611 moves to the second side 3152 under an action of external force, the latching device 60 is at a second state B: the elastic member is stretched to make the latching member 61 disengage from the locking protrusion 141.

Figure 10:
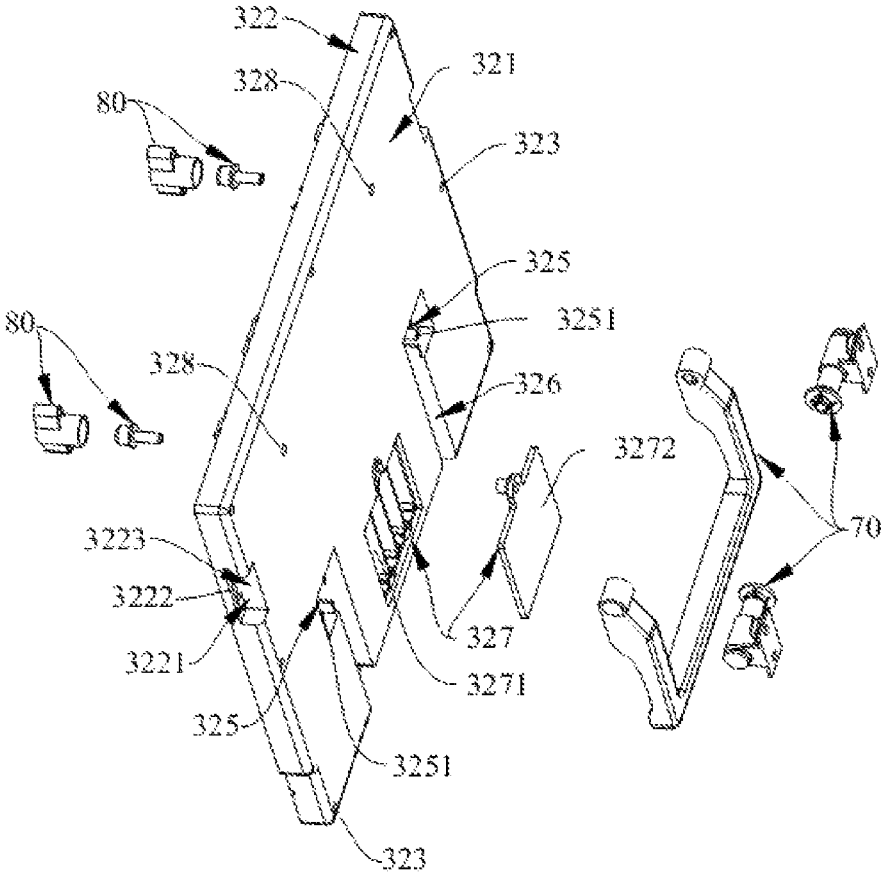
FIG. 10 is an exploded view of a rear frame of the case of the first embodiment of the present invention.

Referring to FIG. 10, in some embodiments, the mirror 30 further includes a support device 70 and resilient devices 80. The support device 70 is arranged on contacting surfaces of the mirror 30 and the cover 10. The resilient devices 80 are arranged in the rear frame 32. When the mirror 30 is taken from the cover 10 and used alone, the support device 70 makes the mirror 30 be placed stably. When the latching devices 60 disengage from the locking protrusions 141, the resilient devices 80 make the mirror 30 break away from the cover 10, thus the mirror 30 can be taken away easily. When the latching devices 60 are engaged with the locking protrusions 141, the position protrusions 121 engage in the position holes 302, thereby keeping the mirror 30 in the cover 10 stably.

Figure 11:
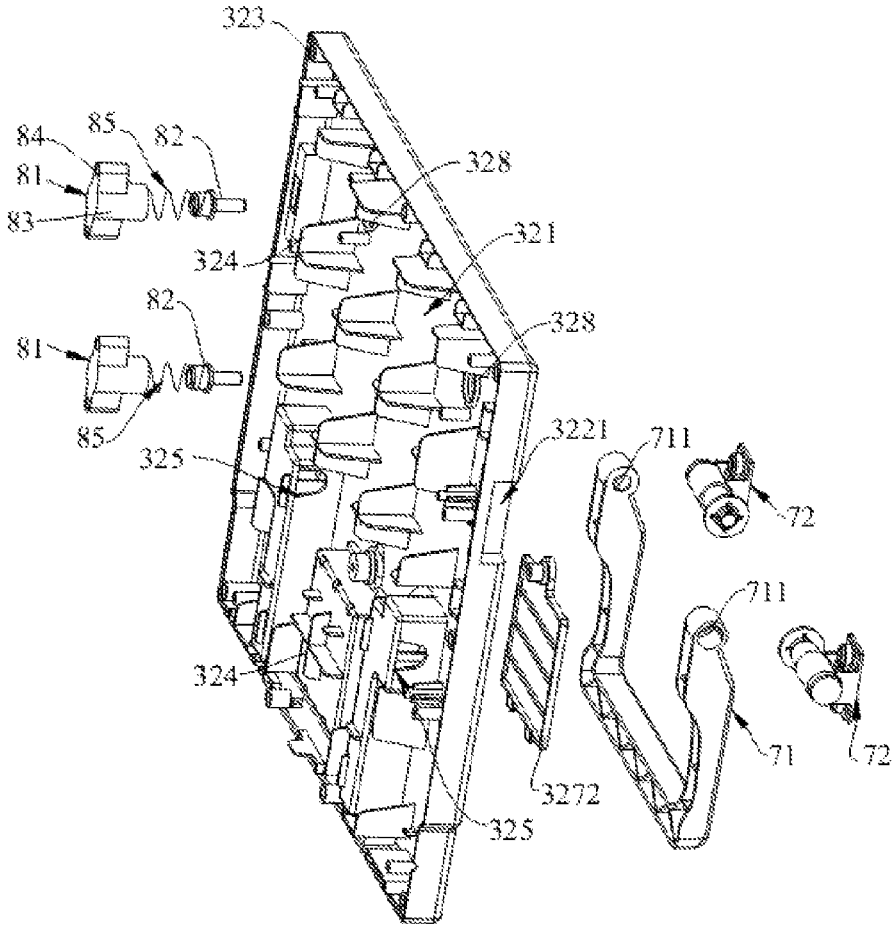
FIG. 11 is an exploded view of the rear frame, viewed from another aspect.

As shown in FIG. 11, in some embodiments, the rear frame 32 includes a second substrate 321 corresponding to the first substrate 311, an eighth sidewall 322 formed at a periphery of the second substrate 321. The second substrate 321 forms first connecting holes 323, a plurality of supporting ribs 324, lower hinged seats 325, a receiving groove 326, a power installation seat 327, and resilient holes 328. The first connecting holes 323 are stepped holes on the second substrate 321 corresponding to some of the first latching holes 3111, fixing devices, such as screws, thereby connecting the front frame 31 and the rear frame 32 together. The supporting ribs 324 are evenly formed on an inner side of the second substrate 321, and cooperate with the first substrate 311 to fix the mirror body 33 there between. The supporting ribs 324 support the mirror body 33 at an inner side, thereby keeping stability of the mirror body 33 in the mirror 30. The lower hinged seats 325, the receiving groove 326, and the power installation seat 327 are formed on an outer side of the second substrate 321, and on a surface of the second substrate 321. The lower hinged seats 325 are two in number and are symmetric to a middle line of the second substrate 321. A second latching hole 3251 is defined adjacent to each lower hinged seat 325, for rotatably connecting the support device 70. The receiving groove 326 is a sink groove fowled between and communicating the two lower hinged seats 325, for receiving the support device 70. The power installation seat 327 is used to install the power source, thereby supplying electric power to the lighting device 40. The resilient holes 328 are through holes, corresponding to the resilient devices 80.

Referring to FIG. 10 again, in some embodiments, the eighth sidewall 322 defines two accommodating rooms 3221, corresponding to the latching parts 612 of the two latching members 61. Each accommodating room 3221 includes an accommodating hole 3222 and an accommodating groove 3223. The accommodating hole 3222 is a rectangular through hole for extending of corresponding latching part 612 there through. The accommodating rooms 3221 provide space for the latching members 61 during engagement or disengagement of the latching parts 612 and the locking protrusions 141.

Referring to FIG. 11 again, in some embodiments, the support device 70 includes a bracket 71 and two hinged units 72 formed at two ends of the bracket 71. Pivot holes 711 are defined in the two ends of the bracket 71 corresponding to the hinged units 72, thereby rotatably connecting the hinged units 72 through the pivot holes 711.

Figure 12:
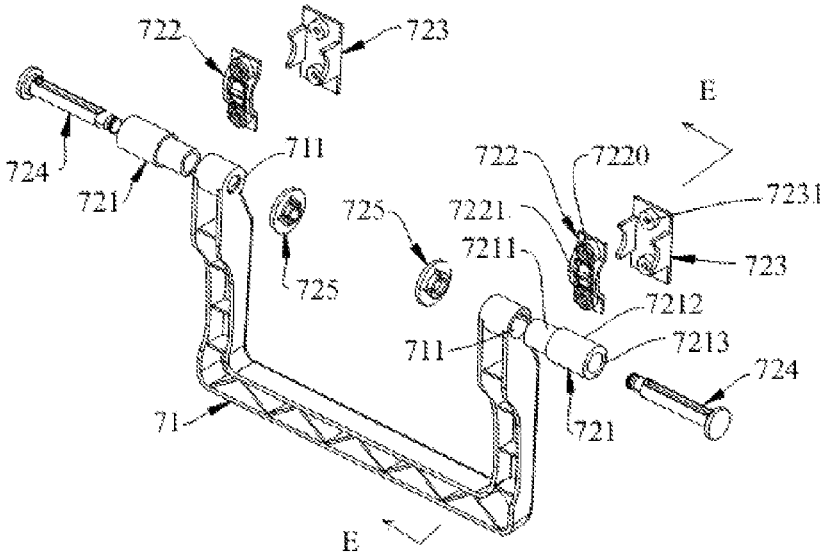
FIG. 12 is an exploded view of a support device of the case of the first embodiment of the present invention.

Referring to FIG. 12, in some embodiments, each hinged unit 72 includes a sleeve 721, a position seat 722, an upper hinged seat 723, a rotating shaft 724, and an axial gasket 725. The sleeve 721 includes a first end 7211 and a second end 7212. The first end 7211 and the bracket 71 are connected by keyway with relative rotation there between limited. Accordingly, pins can also be used to fix the first end 7211 into the pivot hole 711. The second end 7212 is positioned between the upper hinged seat 723 and the lower hinged seat 325. The rotating shaft 724 is inserted in the sleeve 721, and is axially positioned by the axial gasket 725, thus the bracket 71 is rotatable. Four slots 7213 are formed on an outer surface of the second end 7212 along a rotation direction thereof. The position seat 722 is C-shaped, and is arranged between the slots 7213 and the upper hinged seat 723 and tangential to the outer surface of the second end 7212. Fifth connecting holes 7220 are defined in two ends of the position seat 722. The upper hinged seats 723 define sixth connecting holes 7231 corresponding to the fifth connecting holes 7220 and the second latching holes 3251, thereby fixing devices, such as screws, connecting the position seats 722, the upper hinged seats 723 and the lower hinged seats 325 together.

Figure 13:
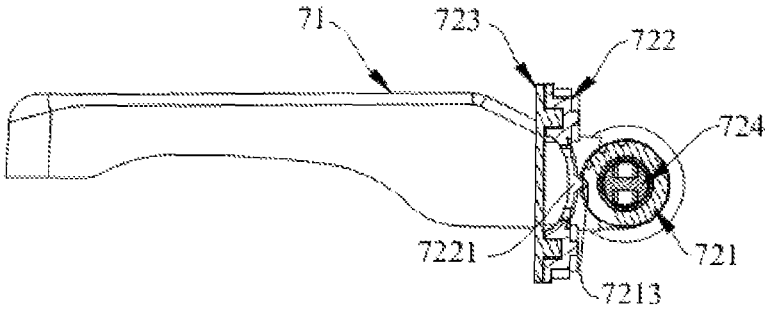
FIG. 13 is a sectional view of the support device taken along line E-E of FIG. 12.

Referring to FIG. 13, in some embodiments, an elastic protrusion 7221 is formed on each position seat 722 at a position thereof contacting the outer surface of the second end 7212, corresponding to the slots 7213. The elastic protrusion 7221 deforms along a normal direction of an outer surface of the sleeve 721 under an action of external force. When the bracket 71 rotates, the sleeve 721 rotates accordingly to make the elastic protrusion 7221 slide along the outer surface of the second end 7212. The elastic protrusion 7221 engages in one of the slots 7213 to lock the bracket 71. The elastic protrusion 7221 engages in different slots 7213 to make the bracket 71 have different angles to the rear frame 32. Numbers of the slots 7213 and distances between the slots 7213 can be designed according to needs. The sleeve 721 and the position seat 722 both can be made of wearable plastics, or elastic and wearable metals. The bracket 71 is rectangular with one side being open, and can be designed to other shapes according to needs.

Referring to FIG. 10 again, in some embodiments, the power installation seat 327 includes a power installation groove 3271 and a covering plate 3272. The power installation groove 3271 is for installation of portable power source, such as battery, which supplies electric power to the lighting device 40. The power source is mounted in the power installation groove 3271 and connected to each other by metal plates, and is connected to the lighting device 40 by the power wires. The power source is fixed by the covering plate 3272. In other embodiments, external power source can also be used to supply electric power to the lighting device 40.

Referring to FIG. 11 again, in some embodiments, the resilient devices 80 are two in number. Each resilient device 80 includes a guiding member 81, an elastic pin 82, and a second elastic member 85. The guiding member 81 includes a cylinder 83 with one end being closed, and eighth connecting holes 84 defined adjacent to the cylinder 83. The second elastic member 85 is received in the cylinder 83 with an outer end thereof connected to the elastic pin 82. An open end of the guiding member 81 orientates to the second substrate 321 and acts with an inner side of the rear frame 32. The guiding members 81 are connected on the rear frame 32 by fixing devices, such as screws. The elastic pin 82 extends through the resilient hole 328 of the second substrate 321 to an outer side of the rear frame 32. When the mirror 30 is mounted in the cover 10, the latching devices 60 engage with the locking protrusions 141, the second elastic members 85 are thus compressed and the elastic pins 82 return back into the resilient holes 328. When the latching devices 60 of the mirror 30 disengage from the locking protrusion 141, the second elastic members 85 resume and make the elastic pins 82 extend out of the resilient holes 328, thereby separation the mirror 30 from the cover 10. In other embodiments, the rear frame 32 can define sink grooves in the outer side thereof, and thus the second elastic members 85 can be arranged between the sink grooves and the cover 10 to achieve rebound function of the mirror 30.

Figure 14:
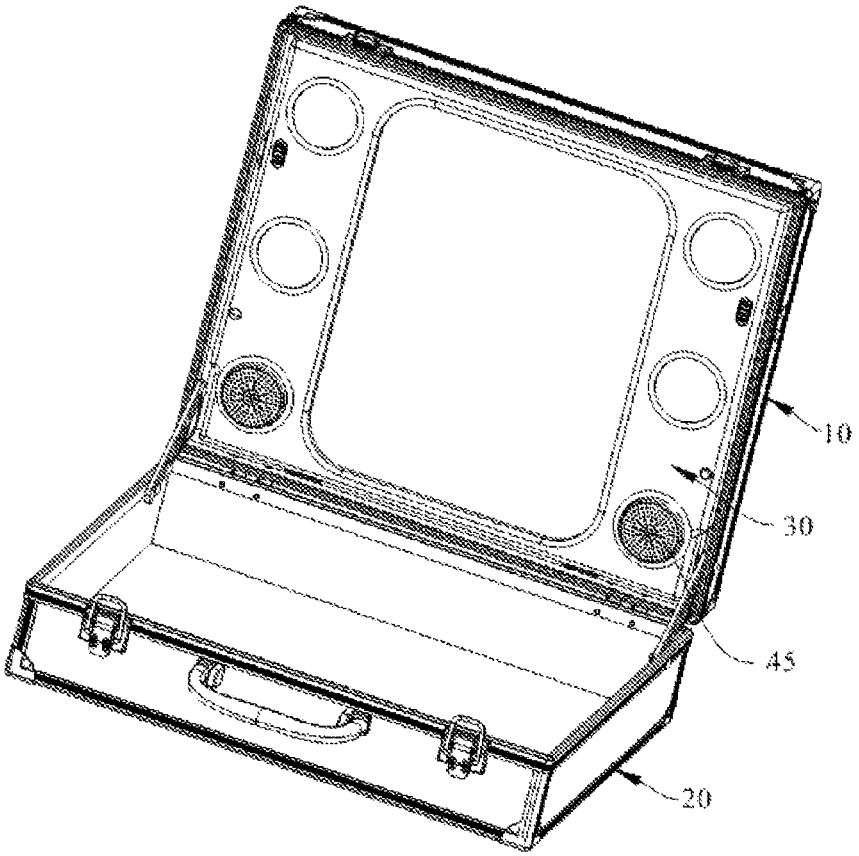
FIG. 14 is schematic view of a case according to a second embodiment of the present invention in an open state.
Figure 15:
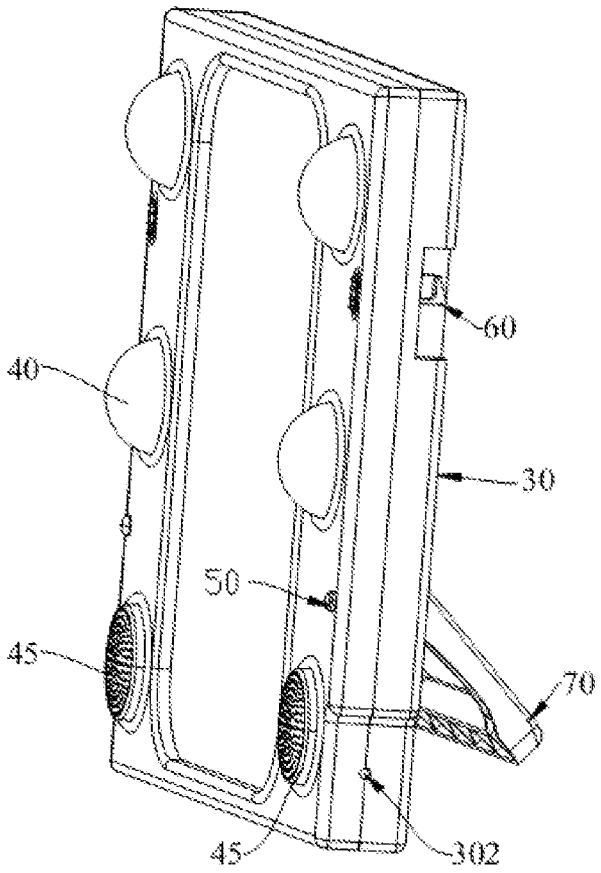
FIG. 15 is a schematic view of a mirror of the case of the second embodiment of the present invention.
Figure 16:
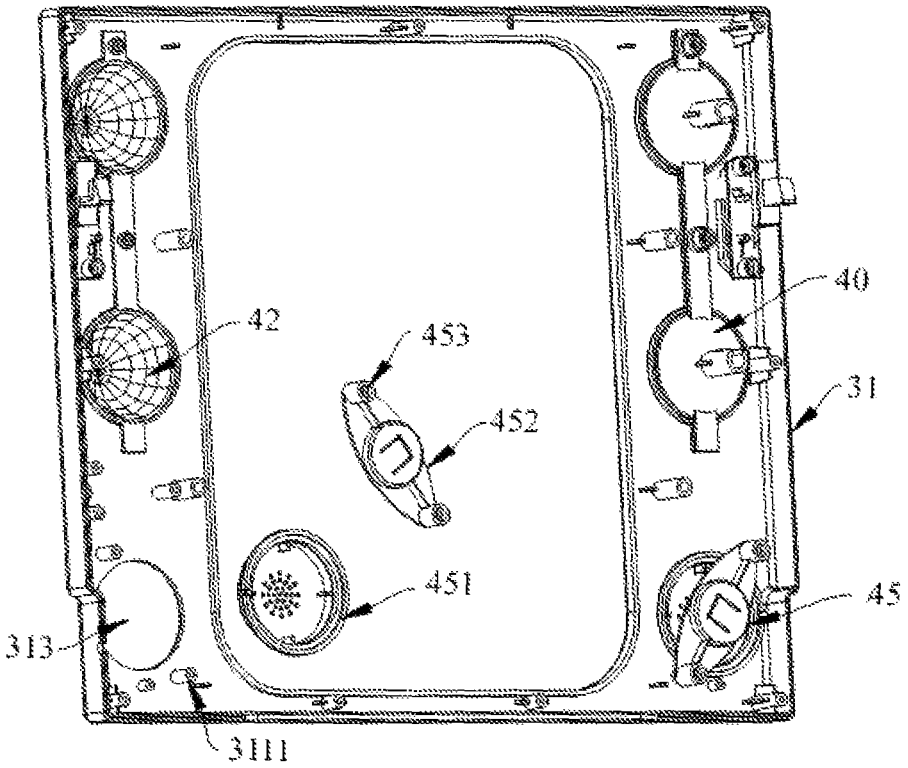
FIG. 16 shows assembled relationship of a front frame of the case of the second embodiment of the present invention.

FIG. 14 to FIG. 16 show a case of a second embodiment of the present invention with detachable mirror 30. One of the lampshades 41 at each side of the case of the first embodiment is replaced by a player 45. Each player 45 includes a speaker, a speaker shade 451, and a pressing plate 452. The speaker shade 451 is mounted on the second mounting hole 313 of the lampshade 41 shown in the first embodiment. The speaker is arranged on the pressing plate 452. Several of the first latching holes 3111 are formed adjacent to the second mounting holes 313. The pressing plates 452 define seventh connecting holes 453 corresponding to the first latching holes 3111, thereby fixing the pressing plates 452 on the front frame 31 through fixing devices, such as screws, and accordingly fixing the speakers and the speaker shades 451 on the front frame 31. The mirror 30 defines an outlet for audio wires, thereby providing audio signals to the speakers by external audio equipments. The speakers output voice or amplify voice. The speaker shade 451 has an outer diameter the same as that of the lampshade 41 in the first embodiment, and thus two of the emitting bodies of the lighting device 40 can be replaced by the players 45 with simple operation, thereby meeting needs of different consumers.

The foregoing is considered to be illustrative of the principles of the present invention. Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A case, comprising:

a base, the base defining a space for accommodating objects and an opening communicating the space with an external environment;

a cover, the cover being hinged onto the base for sealing the opening of the base, and a mirror being detachably mounted in the cover with a back side of the mirror facing the cover;

wherein the mirror comprises a support device for supporting the mirror when the mirror is used alone;

wherein the mirror comprises a frame and a mirror body, the frame being detachably mounted on the cover, the mirror body being mounted in the frame, the support device comprising a bracket and a hinged unit;

the frame comprising a lower hinged seat, the hinged unit being mounted on the lower hinged seat, the bracket being rotatably connected to the hinged unit, wherein when the bracket rotates to a first position, the bracket is received in the frame of the mirror, and when the bracket rotates to a second position, the bracket and the frame form an angle there between for stably placing the mirror;

wherein the hinged unit comprises a sleeve, a position seat, an upper hinged seat and a rotating shaft; the sleeve comprises a first end and a second end, the first end being fixedly connected to the bracket, the second end being arranged between the upper hinged seat and the position seat, the rotating shaft being inserted in the sleeve, thereby the bracket being rotatable, a plurality of slots being evenly defined on an outer surface of the second end along a rotation direction thereof, the position seat being tangential to the outer surface of the second end; the position seat respectively defining a fifth connecting hole in two ends thereof for fixedly connecting the lower hinged seat, wherein the position seat forms an elastic protrusion corresponding to the slots, the elastic protrusion engages in one of the slots to lock the bracket, and the elastic protrusion engages in different slots to adjust the angle between the bracket and the frame.

2. The case of claim 1, wherein the mirror comprises a lighting device and/or a player, the lighting device being used for providing sufficient intensity illumination in dark, the player being used for playing audio.

3. The case of claim 1, wherein the cover comprises a locking protrusion, the mirror comprises a latching device acting with the locking protrusion to form detachability of the mirror and cover, wherein when the latching device is in a first state, the latching device engages with the locking protrusion; and when the latching device is in a second state, the latching device disengages from the locking protrusion.

4. The case of claim 3, wherein the latching device comprises a resetting member, the resetting member driving the latching device back to the first state when external force acting on the latching device is canceled.

5. The case of claim 4, wherein the latching device further comprises a latching member and a second fixing member, the latching member is mounted on the mirror, the latching member comprising an operation part and a latching part, the operation part and the latching part being respectively formed at opposite ends of the latching member, the operation part being exposed out of the mirror, the latching part being a hook extending towards the back side of the mirror for acting with the locking protrusion, the second fixing member defining a fourth connecting hole for connecting the latching part and the mirror.

6. The case of claim 5, wherein the resetting member comprises a fixing protrusion formed on the second fixing member, a guiding protrusion formed on the latching member, and a first elastic member interconnecting the fixing protrusion and the guiding protrusion, the second fixing member defining a guiding groove for limiting movement of the guiding protrusion, wherein when the external force acting on the latching device is canceled, the guiding protrusion drives the latching member to move along the guiding groove until the latching device is in the first state.

7. The case of claim 3, wherein the cover comprises a sidewall, the sidewall comprising a position protrusion formed thereon, the mirror defining a position hole corresponding to the position protrusion, thereby ensuring stability of the mirror when the mirror is mounted in the cover.

8. The case of claim 2, wherein the mirror comprises a frame and a mirror body, the frame being detachably connected to the cover, the mirror body being fixed on the frame, the frame defining a power installation seat for mounting portable power source which supplies electric power to the lighting device and/or the player.

9. The case of claim 8, wherein a control unit is arranged on the frame of the mirror for controlling connection between the power source and the lighting device and/or the player.

10. The case of claim 1, wherein the frame comprises a front frame and a rear frame, the front frame and the rear frame fixing the mirror body therebetween, a first mounting hole being defined in the front frame, the mirror body being mounted in the first mounting hole and orientated towards the base, the rear frame being coupled to an inner side of the cover.

11. The case of claim 3, wherein the mirror comprises a frame and a mirror body, the frame being detachably connected to the cover, the mirror body being fixed on the frame; wherein the frame comprises a front frame and a rear frame for fixing the mirror body therebetween; the rear frame comprises a second substrate, a resilient hole is arranged on the second substrate, and at least one resilient device is arranged inside the resilient hole formed in the rear frame, wherein when the latching device engages with the locking protrusion, the resilient device is received in the resilient hole in the rear frame, and when the latching device disengages from the locking protrusion, the resilient device separates the mirror from the inner side of the cover.

12. The case of claim 1, wherein the case is cosmetics case.

13. The case of claim 1, wherein the cover comprises a top wall, and sidewalls formed around the top wall, the top wall and the sidewalls cooperatively defining a first space, the mirror being detachably mounted in the first space and having a size matching the first space.

* * * * *